US005386629A

United States Patent [19]

Ouchi et al.

[11] Patent Number: 5,386,629

[45] Date of Patent: Feb. 7, 1995

[54] TUBE FOR HEAT EXCHANGERS AND A METHOD FOR MANUFACTURING THE TUBE

[75] Inventors: Wataru Ouchi, Shimodateshi; Katsuhisa Suzuki, Utsunomiyashi; Toshinori Tokutake, Oyamashi; Hirosaburo Hirano, Utsunomiyashi, all of Japan

[73] Assignee: Showa Aluminum Kabushiki Kaisha, Osaka, Japan

[21] Appl. No.: 210,749

[22] Filed: Mar. 17, 1994

Related U.S. Application Data

[60] Continuation of Ser. No. 961,611, Oct. 15, 1992, abandoned, which is a division of Ser. No. 693,955, Apr. 29, 1991, Pat. No. 5,186,250.

[30] Foreign Application Priority Data

May 11, 1990 [JP] Japan ..... 2-122289
Jul. 27, 1990 [JP] Japan ..... 2-200206

[51] Int. Cl.[6] ..... B23P 15/26

[52] U.S. Cl. ..... 29/890.046; 29/890.013; 29/890.053

[58] Field of Search ..... 29/890.043, 890.046, 29/890.049, 890.053; 72/368; 165/177

[56] References Cited

U.S. PATENT DOCUMENTS

| | | | |
|---|---|---|---|
| 349,060 | 9/1886 | Serve | 29/890.049 |
| 2,151,540 | 3/1939 | Varga | 29/890.049 |
| 3,603,384 | 9/1971 | Huggins | 29/890.053 |
| 3,662,582 | 5/1972 | French | 29/890.016 |
| 4,558,695 | 12/1985 | Kumazawa et al. | 29/890.053 |

FOREIGN PATENT DOCUMENTS

| | | | |
|---|---|---|---|
| 0283937 | 9/1988 | European Pat. Off. . | |
| 2156359 | 5/1973 | France . | |
| 1501537 | 6/1969 | Germany . | |
| 3245531 | 6/1984 | Germany . | |
| 3704215 | 8/1988 | Germany . | |
| 0067529 | 4/1986 | Japan | 29/890.049 |
| 0108411 | 4/1990 | Japan | 29/890.049 |
| 4001210 | 1/1992 | Japan | 29/890.049 |
| 2223091 | 3/1990 | United Kingdom . | |

*Primary Examiner*—Irene Cuda

[57] ABSTRACT

A tube for heat exchangers is a flat tube which either includes a pair of plane walls which are spaced a predetermined distance from one another, the plane walls respectively having one lateral ends integrally connected to each other by a U-shaped bent portion, the plane walls further having their other lateral ends which abut against to be tightly secured to one another, or alternatively, the flat tube includes as the plane walls a pair of preformed plates having the abutted and soldered portions at both lateral ends. The tube further includes one or more curved lugs integral with and protruding inwardly from an inner surface of each plane wall, and the curved lugs respectively having innermost tops so that the innermost tops protruding from one plane wall bear against the inner surface of the other plane wall or against the innermost tops of the other curved lugs protruding from said other plane wall. The tube is thus of an improved pressure resistance despite its minimized height or thickness, and the manufacturing process of the tube involves no difficulty to produce the tubes at a high productivity and lower manufacturing cost.

8 Claims, 7 Drawing Sheets

TUBE FOR HEAT EXCHANGERS AND A METHOD FOR MANUFACTURING THE TUBE

This application is a continuation of application Ser. No. 961,611, filed Oct. 15, 1992, abandoned, which is a divisional of application Ser. No. 693,955, filed Apr. 29, 1991, now U.S. Pat. No. 5,186,250, the text of which is hereby incorporated by reference.

BACKGROUND OF THE INVENTION

1. Field of the Invention

The invention relates to a tube for heat exchangers and a method for manufacturing the tube, more particularly, the tube being of a flat or depressed shape adapted to compose the multiflow heat exchangers which are used as the condensers in car cooler systems.

2. Description of Prior Art

The condensers in the car cooler systems has generally been the heat exchangers of the so-called serpentine-tube type. Cores as the principal parts of such prior art heat exchangers each comprises a "harmonica" tube and fins combined therewith, this tube being a flat extruded tube having internal and longitudinal openings and being bent zigzag several times to thereby form some portions parallel with one another, with each fin being disposed between those portions.

Another kind of prior art heat exchangers is of such a structure as called "multiflow" type, and has recently been proposed and employed to reduce the flow resistance of coolant, to improve the heat transfer efficiency, to render lighter the weight and less thick the volume of the condensers. The multiflow type heat exchangers comprise, for example as shown in FIG. 13, a pair of right and left headers 31 and 32 made of a metal pipe. A plurality of flat tubes 33 are connected at their ends to the headers in fluid communication therewith. Fins 34 are each interposed two adjacent tubes 33 and 33. Partitioning members 35 are each secured inside the headers 31 and 32 at suitable positions intermediate of their ends so that internal spaces of the headers are divided into some longitudinal compartments. Thus, a coolant passage of a zigzag pattern is formed to start from a coolant inlet 36 at an upper end of one header 31 and then to terminate at a coolant outlet 37 at a lower end of the other header 32 (as disclosed, for example, in the U.S. Pat. No. 4,825,941).

The abovementioned tubes 33 in the multiflow type heat exchangers have in general been certain flat or depressed aluminum tubes which are produced by the extrusion forming method and comprise the longitudinally extending openings, because the tubes must withstand well the high pressure of the compressed gaseous coolant employed in the heat exchangers. As shown in FIG. 14, each of those tubes has a peripheral wall 33*a* which is of a shape of ellipse in its cross section. Each tube has also one or more longitudinal partitions 33*b* to divide the internal space into some separate coolant paths 33*c*.

However in all cases wherein the extruded tubes 33 are employed, their height "H" which is restricted by the manufacturing process have been a bottleneck preventing the heat transfer efficiency from being raised above a certain upper limit. As will be understood, higher efficiency of heat transfer within a heat exchanger may be achieved effectively by minimizing the flow resistance of air which flows through the core of a given contour dimension, and at the same time, by increasing the core's overall surface in contact with the air flow. In other words, the extruded tubes 33 of the height "H" which has not been lowered to a sufficient degree have caused an increase of the air flow resistance and placed restrictions on the number of tubes installed within each core of the given contour dimension, thus failing to increase the core's surface contacting the air flow.

Seam-welded pipes have been proposed for use as the tubes in order to eliminate such a drawback (for example, see the Japanese Patent Publication 62-207572). The wall of seam-welded tubes can be rendered sufficiently thin to a thickness of about 0.4 to 0.5 mm, remarkably decreasing the tube's height to about 1.5 to 1.7 mm.

Such an extremely thin wall per se of the seam-welded tubes cannot withstand the high pressure gaseous coolant which is supplied from a compressor to the tubes of the condensers. To resolve this problem, the prior art as disclosed on said Patent Publication 62-207572 makes use of an inner fin member inserted into each flat seam-welded tube. Those inner fin members which are previously corrugated in transverse direction before insertion are each soldered to the inner surface of tube so as to function also as a reinforcing member which enhances to the tube a required resisting pressure.

The prior art tubes seam-welded and reinforced are however not necessarily easy to manufacture. Particularly, it is considerably difficult to insert the inner fin member the entire length of each tube which is extremely thin, whereby productivity is lowered raising the manufacturing cost.

OBJECTS AND SUMMARY OF THE INVENTION

Therefore a first object of the present invention which was made to resolve the aforementioned problems is to provide a tube composing heat exchangers which are particularly suited for use as condensers, the tube being not only of a height or thickness suppressed to such a degree as ensuring an improved heat transfer efficiency, but also being of a higher resisting pressure and easy to manufacture.

A second object of the invention is to provide a method to manufacture a tube for heat exchangers, which tube has such features as just described in respect of the first object.

Other objects will become apparent from the preferred embodiments described below.

From an aspect of the invention, the first object is achieved with a tube for heat exchangers which comprises a pair of plane walls spaced a predetermined distance from one another, the plane walls respectively having one lateral ends integrally connected to each other by a U-shaped bent portion, the plane walls further having their other lateral ends which abut against and are tightly secured to one another to define a flat configuration of the tube, one or more curved lugs integral with and protruding inwardly from an inner surface of each plane wall, the curved lugs respectively having innermost tops, with the innermost tops of the curved lugs protruding from one plane wall bear against and integral with the inner surface of the other plane wall or with the innermost tops of the other curved lugs protruding from said other plane wall.

From another aspect of the invention, the first object is achieved with a tube for heat exchangers which comprises a pair of preformed plates spaced a predetermined distance from one another, the preformed plates being tightly secured to one another at both lateral ends to define a flat configuration of the tube, one or more curved lugs integral with and protruding inwardly from an inner surface of each preformed plate, and the curved lugs respectively having innermost tops, with the innermost tops of the curved lugs protruding from one preformed plate bear against and integral with the inner surface of the other preformed plate or with the innermost tops of the other curved lugs protruding from said other preformed plate. From a further aspect of the invention, the second object is accomplished by a method for manufacturing a tube for heat exchangers, the method comprising the steps of: preparing a strip of a predetermined width; forming one or more curved lugs integrally protruding from inner surfaces of both lateral sides of a middle portion of the strip; bending the strip, having the curved lugs, at the middle portion into a U-shape in cross section to form plane walls corresponding to the lateral sides; then abutting lateral extremities of the plane walls one on another; welding the lateral extremities one to another to form an ellipse in cross section such that innermost tops of the curved lugs of one plane wall do engage with the inner surface of the other plane wall or with opposite innermost tops of the other curved lugs of said other plane wall; and then soldering the innermost tops to the inner surface or to the opposite innermost tops with which they are engaging.

From a still further aspect, the second object is achieved by a method for manufacturing a tube for heat exchangers, the method comprising the steps of: preparing a strip of predetermined width; forming one or more curved lugs integrally protruding from inner surfaces of both lateral sides of middle portion of strip; bending the strip, having the curved lugs, at the middle portion into a U-shape in cross section to form plane walls corresponding to the lateral sides; then abutting lateral extremities of the plane walls one on another to form an ellipse in cross section such that innermost tops of the curved lugs of one plane wall engage with the inner surface of the other plane wall or with opposite innermost tops of the other curved lugs of said other plane wall; and then soldering in one operation the lateral extremities abutting one on another as well as the innermost tops to the inner surface or to the opposite innermost tops with which they are engaging. Each curved lug may be a tightly folded gather extending along the tube. This type of the curved lugs may alternately protrude from one and the other plane walls of the tube so as to divide an internal space thereof into a plurality of separate coolant paths. Alternatively, each curved lug may be a dimpled recess also formed integral with either plane wall. A plurality of this further type of the curved lugs are distributed over the inner surfaces of either or both plane walls so as to form a zigzag coolant path within the tube.

BRIEF DESCRIPTION OF THE DRAWINGS

In the drawings illustrating the preferred embodiments of the present invention.

THE PREFERRED EMBODIMENTS

First Embodiment

Figure 1:
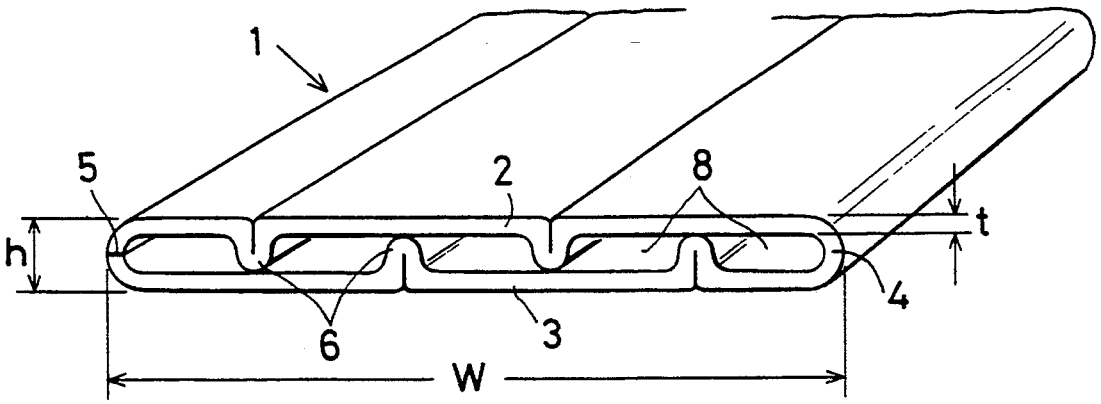
FIG. 1 a perspective view of a tube provided according to a first embodiment.

In a first embodiment shown in FIGS. 1 and 2, a tube 1 for heat exchangers comprises a pair of upper and lower plane walls 2 and 3 disposed facing one another and spaced a predetermined distance, for example 0.8 mm, from each other. The plane walls 2 and 3 respectively have one lateral ends integrally connected to each other by a U-shaped bent portion 4. The plane walls further have their other lateral ends which abut against to be tightly welded one to another at a point 5, thereby forming a flat seam-welded pipe of an ellipse-like shape in its cross section. The tube 1 further comprises two curved lugs 6 integral with and protruding inwardly from an inner surface of each plane wall 2 and 3 so that two lugs 6 of one plane wall 2 and two other lugs 6 of the other plane wall 3 alternate in a transverse direction thereof. Each curved lug 6 is formed by inwardly recessing a portion of the plane wall 2 or 3 into a V-shape and by subsequently pressing two opposing legs of "V" into close contact with each other, thereby forming a double-ply wall portion. The curved lugs thus extend longitudinally of the tube 1. An innermost top of each curved lug 6 protruding from one plane wall 2 or 3 bears against the opposite inner surface of the other plane wall 3 or 2. The innermost tops are soldered to said opposite inner surface, while the two contacting V-legs of said double-ply wall portion are also soldered integral with each other. Such a soldering of the abutting or contacting portions is effected by making use of soldering agent layers of a both-sided aluminum brazing sheet which is used to form the tube. Therefore, the soldering may be performed at the same time as fins 34 and tubes 1 are soldered together and tubes 1 and headers 31 and 32 are soldered together when assembling the heat exchanger.

As a result, the curved lugs 6 function as partitions which divide an internal space of the soldered tube 1 into a plurality of separate coolant paths 8 arranged in the transverse direction of tube 1.

Wall thickness "t" of the tube 1 may be 0.15 to 0.5 mm, and more preferably 0.4 mm as an example. Tube width "w" may be 12 to 20 mm, and more preferably 16 mm as an example, with tube height "h" designed to be 1.2 to 2.0 mm, more preferably to be for example 1.6 mm.

Figures 2A, 2B, 2C, 2D:
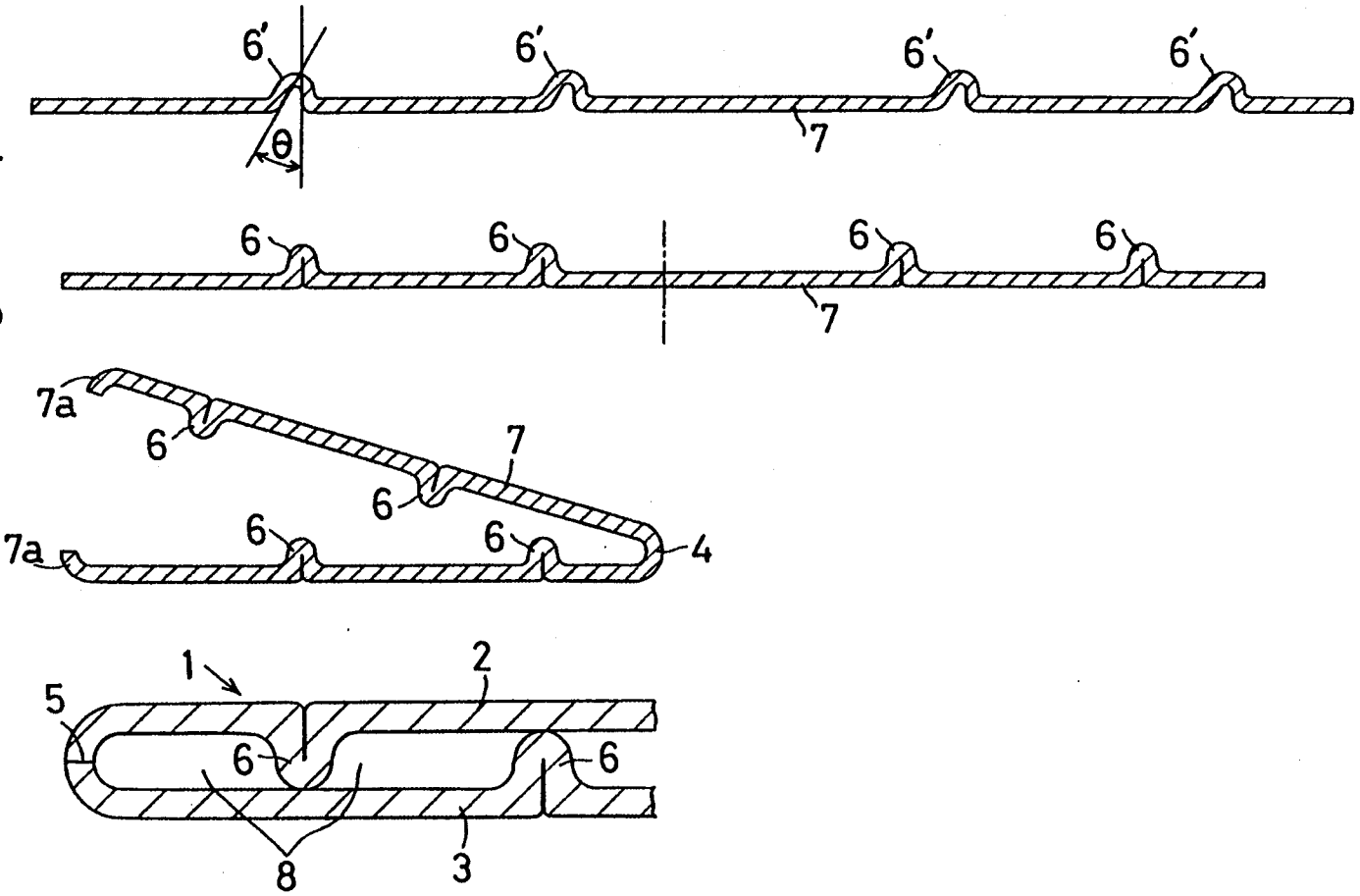
FIGS. 2*a* to 2*d* are cross-sectional views showing a process for manufacturing the tube in the first embodiment.

In order to manufacture the tube 1, a strip 7 of the aluminum brazing sheet of a predetermined width is prepared to be processed as shown in FIG. 2*b*. One or more curved lugs 6 are formed by folding longitudinal portions of the strip to protrude in the same direction from surfaces of right and left lateral sides of a transverse middle portion of the strip 7, which portion is bent later. More in detail as shown in FIG. 2*a*, formed at first are beaded portions 6' of an "italic-V" shape which has an upright leg perpendicular to the strip surface and an oblique leg inclined toward the upright leg by an angle $\theta$ of about 30°. As the next step, each beaded portion 6' is subjected to a trimming operation wherein the legs thereof are gathered into close contact with each other, thereby producing a desired neat shape of the curved lugs 6 as illustrated in FIG. 2*b*.

Subsequently, the strip 7 comprising such curved lugs 6 is bent at its transverse middle portion into a U-shape which has a predetermined radius of curvature, as shown in FIG. 2*c*. Portions adjacent to lateral extremities 7*a* and 7*a* are slightly bent in opposite directions so as to abut one on another, with the abutted portions being seam-welded then as denoted by the reference numeral 5 in FIG. 2*d*. FIG. 2*d* shows the thus manufactured flat tube 1 in part and on an enlarged scale, the tube having a predetermined dimension and being of an ellipse-shape as a whole in its cross section.

Figure 3:
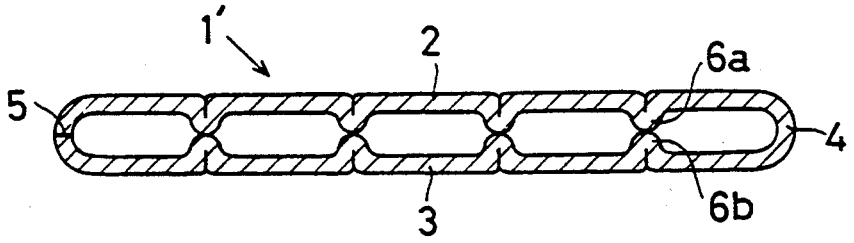
FIG. 3 shows a modified tube in the first embodiment.

FIG. 3 illustrates a modified tube 1' comprising curved lugs 6*a* and 6*b* which are of a smaller height and protrude from opposite corresponding portions of the upper and lower plane walls 2 and 3, respectively. Innermost tops of the opposite curved lugs 6*a* and 6*b* abut one on another and are soldered there to be integral with each other. Other features as well as the manufacturing method are the same as or similar to the tube 1 in the first embodiment.

Figure 4:
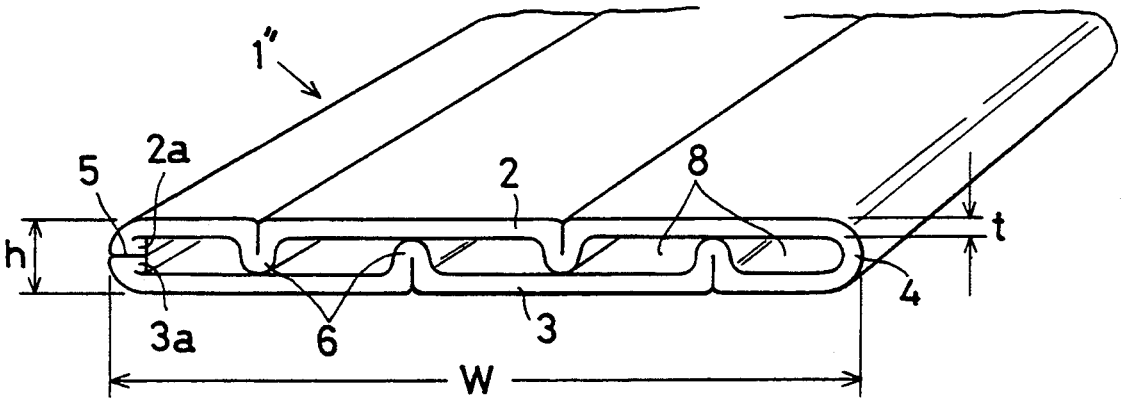
FIG. 4 is a perspective view of a further modified tube in the first embodiment.

FIG. 4 shows a further modified tube 1'' which comprises the upper and lower strip-like plane walls 2 and 3 spaced apart, for example, 0.8 mm. The plane walls have one lateral ends integrally connected by the U-shaped bent portion 4, with other lateral ends being soldered one to another to thereby form a flat tube of an ellipse-shape in cross section. The other lateral ends of the walls 2 and 3 have been folded down parallel and inwardly to form creased edges 2*a* and 3*a* which are of a predetermined width, before the creased edges 2*a* and 3*a* are engaged with and soldered to each other at the region 5. Such a binding structure is more advantageous than the simple abutting and soldering of lateral ends as in the other cases already described, because the binding operation is easier and the soldering process in an oven becomes sure and smooth. The binding of lateral ends may be effected either by the soldering or the seam-welding method. It is preferable to solder said lateral ends at the same time together with other members of heat exchanger in a one-shot operation, wherein the soldering agent layers of both-sided aluminum brazing sheet may be utilized advantageously. In the one-shot operation, the soldering of fins 34 to tubes 1 as well as the soldering thereof to headers 31 and 32 are carried out simultaneously as the lateral ends of tube walls are soldered.

Other features of this modified tube and details of its manufacture are the same as or similar to the tube 1 in the first embodiment.

Figure 5:
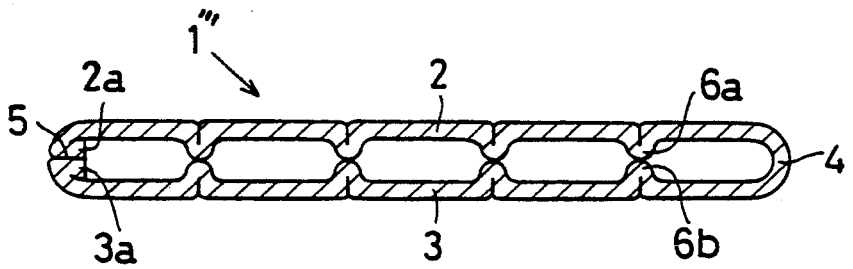
FIG. 5 is a cross-sectional view of a still further modified tube.

FIG. 5 shows a still further modified tube 1''' comprising curved lugs 6*a* and 6*b* which are of a smaller height and protrude from opposite corresponding portions of upper and lower plane walls 2 and 3, respectively. Innermost tops of the opposite curved lugs 6*a* and 6*b* abut one on another and are soldered there to be integral with each other. Other features of this modified tube and details of its manufacture are the same as or similar to the tube shown in FIG. 4.

Second Embodiment

Figure 6:
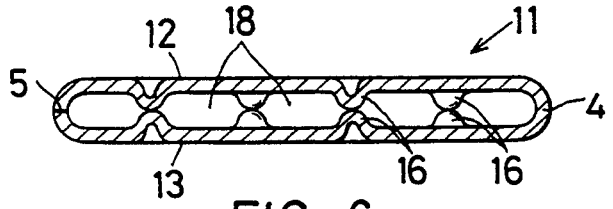
FIG. 6 is a cross-sectional view of a tube provided according to a second embodiment of the invention.
Figure 7:
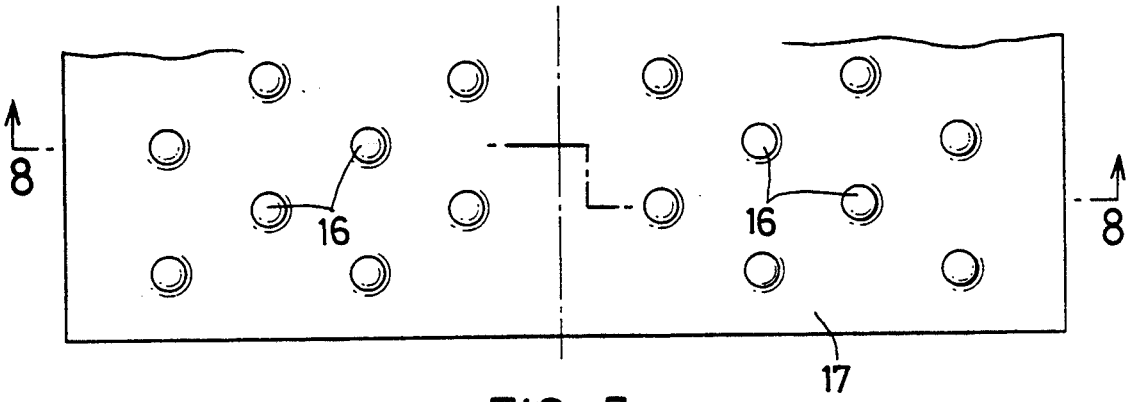
FIG. 7 is a plan view of a strip which is being processed to form the tube in the second embodiment.
Figure 8:
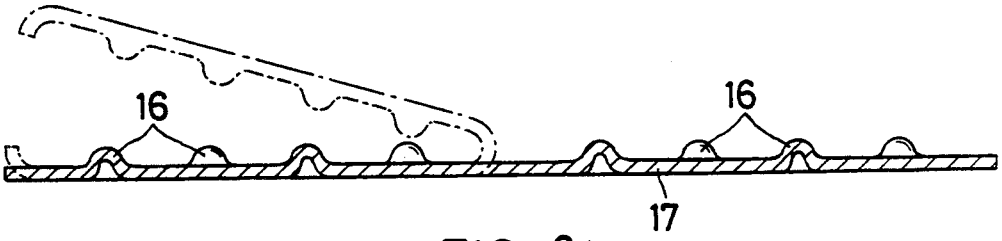
FIG. 8 is a cross-sectional view taken along the line 8—8 in FIG. 7.

In a second embodiment shown in FIGS. 6 to 8, a tube 11 comprises curved lugs 16 which protrude inwardly from separate portions of upper and lower plane walls 12 and 13. Those lugs 16 are provided by recessing the portions of walls 12 and 13 inwardly into semi-spherical or U-shaped dimple-like shape in cross section. Thus, a plurality of the dimple-like curved lugs 16 are distributed over each plane wall. Respective innermost tops of the lugs 16 on upper wall correspond to and engage with respective innermost tops of the lugs 16 on lower wall so that they are soldered there to be integral with each other. An inner space of the tube 11 becomes a single coolant path 18 of a stray or zigzag pattern due to such scattered dimple-like curved lugs 16. The coolant flowing through this path 18 in the tube 11 will be stirred by the curved lugs 16 to thereby facilitate the exchange of heat.

Details of other structural features of this tube 11 are the same as those of the first embodiment in FIGS. 1 and 2, and therefore will not be repeated here.

Similarly to the case shown in FIGS. 1 and 2, the tube 11 is made from a strip 17 of aluminum brazing sheet, which strip 17 is of a predetermined width as shown in FIGS. 7 and 8. The dimple-like curved lugs 16 are formed at predetermined points of the strip before it is folded into U-shape in cross section at its transverse middle portion, as shown by the phantom line in FIG. 8. After that, the strip's lateral ends abutting one on another are seam-welded as shown by the numeral 5 so as to define a flat depressed tube.

Also in a modification of the second embodiment, the curved lugs 16 on one of the plane walls 12 may also be arranged at positions different from those on the other plane wall 13, in a manner similar to that described hereinbefore. The innermost tops of those lugs engage with the opposite plane wall and are soldered thereto.

Third Embodiment

Figure 9:
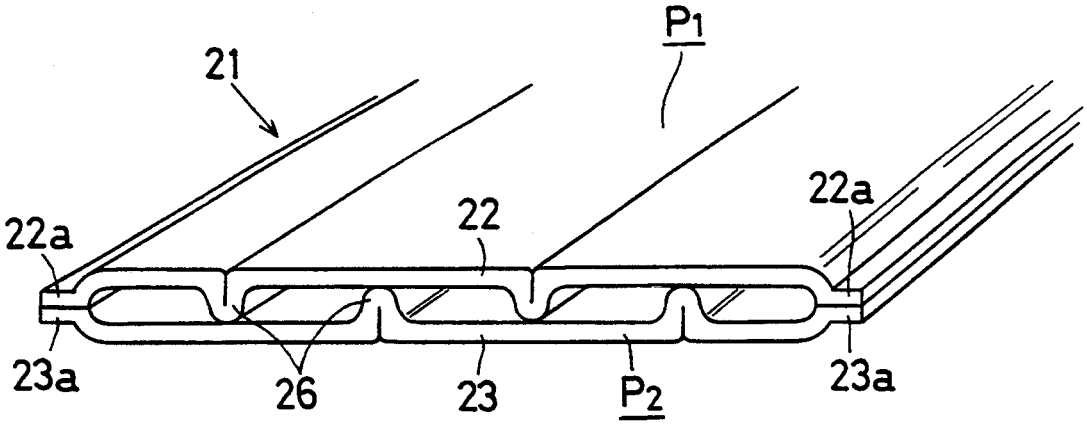
FIG. 9 is a perspective view of a tube provided according to a third embodiment of the invention.
Figure 10:
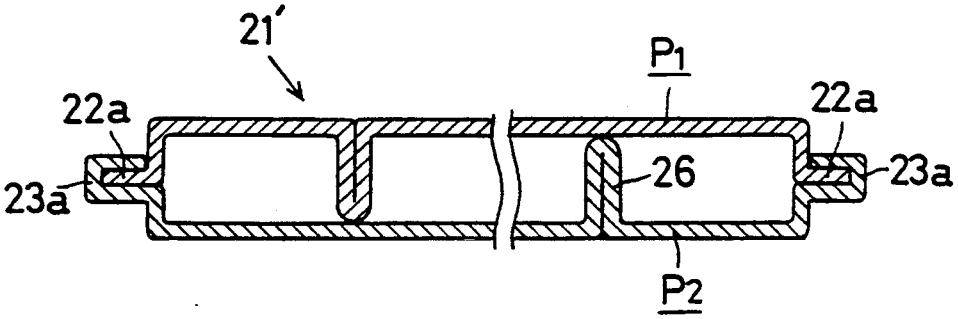
FIG. 10 is a cross-sectional view of a modified tube in the third embodiment.

In a third embodiment shown in FIG. 9, a tube 21 is composed of two preformed plates $P_1$ and $P_2$. Curved lugs 26 protruding inwardly and longitudinally of one plate $P_1$ and other ones 26 of the other plate $P_2$ alternate in the transverse direction thereof. The preformed plates are arranged such that their curved lugs are disposed inwardly with lateral ends of said plates, i.e., plane walls, facing one another to be soldered and united. The number of curved lugs 26 is two for each preformed plate.

Both lateral ends of each preformed plate $P_1$ or $P_2$ are L-shaped bent portions 22*a* or 23*a* which abut each other and are soldered to be integral with one another. They may not be soldered but welded, if necessary. Other structural features of this tube 21 are the same as those in the first and second embodiments, therefore description thereof-being omitted here.

The third embodiment may also be modified such that the curved lugs 26 on the upper plane wall 22 arranged offset to those on the lower plane wall 23, wherein innermost tops of those lugs are engaged with and soldered to each other.

To facilitate the assembling of tube 21, its plates $P_1$ and $P_2$ are preferably set temporarily or preliminarily prior to the soldering thereof. As an example, the edges of L-shaped bent portions 23*a* of lower plate $P_2$ may be bent again upwards and inwards, along the full length of tube 21′, into a U-shape. Each of the U-shaped edges tightly embraces the corresponding bent portion 22*a* of upper plate 22*a*. In detail, the upper and lower L-shaped portions 22*a* and 22*b* are formed at first so that the upper one can be slidingly inserted into the lower one.

Figure 11A:
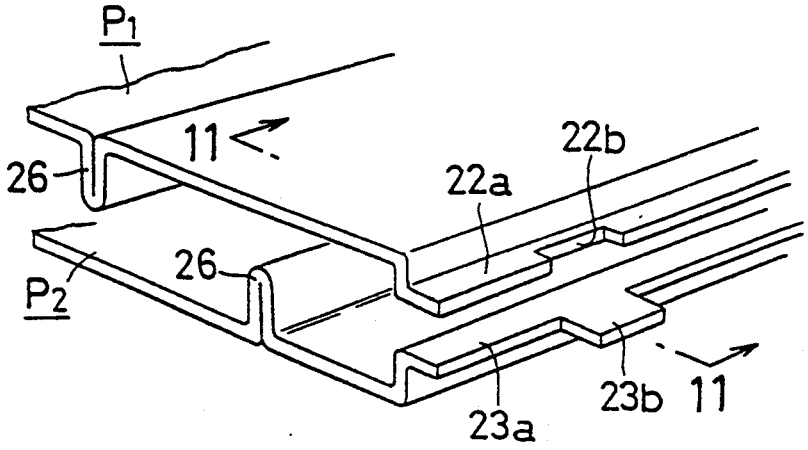
FIG. 11*a* is a perspective view showing a further modified tube, with its preformed plates being separated.
Figure 11B:
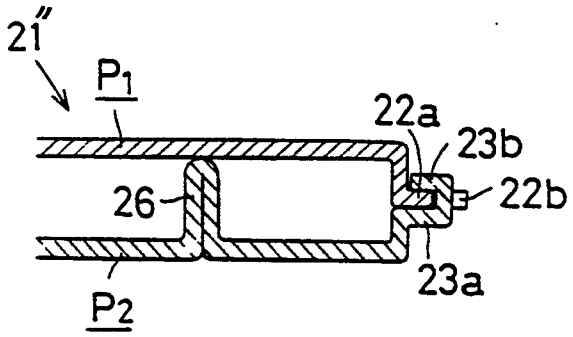
FIG. 11*b* is a cross-sectional view taken along the line 11—11 in FIG. 11*a* and showing the further modified tube, with its preformed plates being integrated.
Figure 12A:
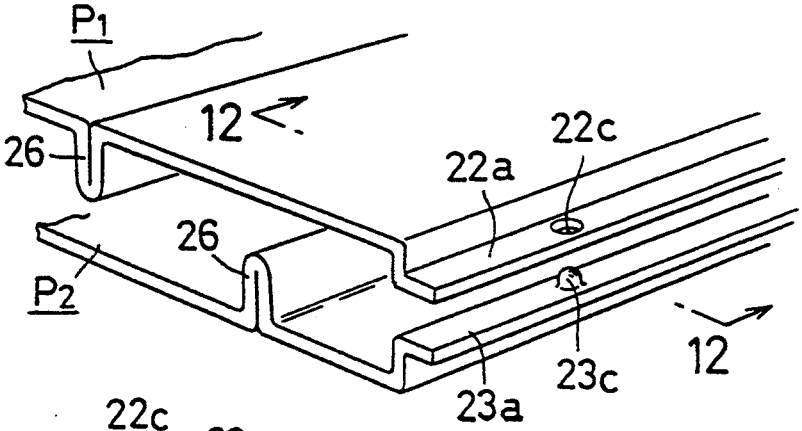
FIG. 12*a* is a perspective view showing a still further modified tube, with its preformed plates being separated.
Figure 12B:
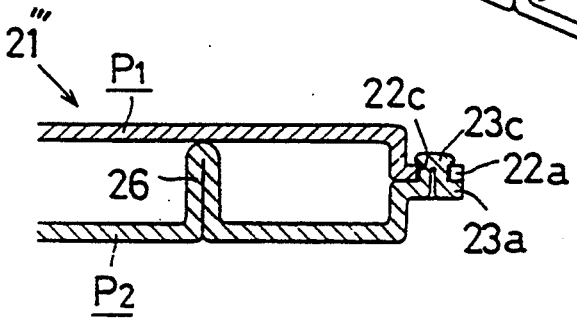
FIG. 12*b* is a cross-sectional view taken along the line 12—12 in FIG. 12*a* and showing the still further modified tube, with its preformed plates being integrated.
Figure 13:
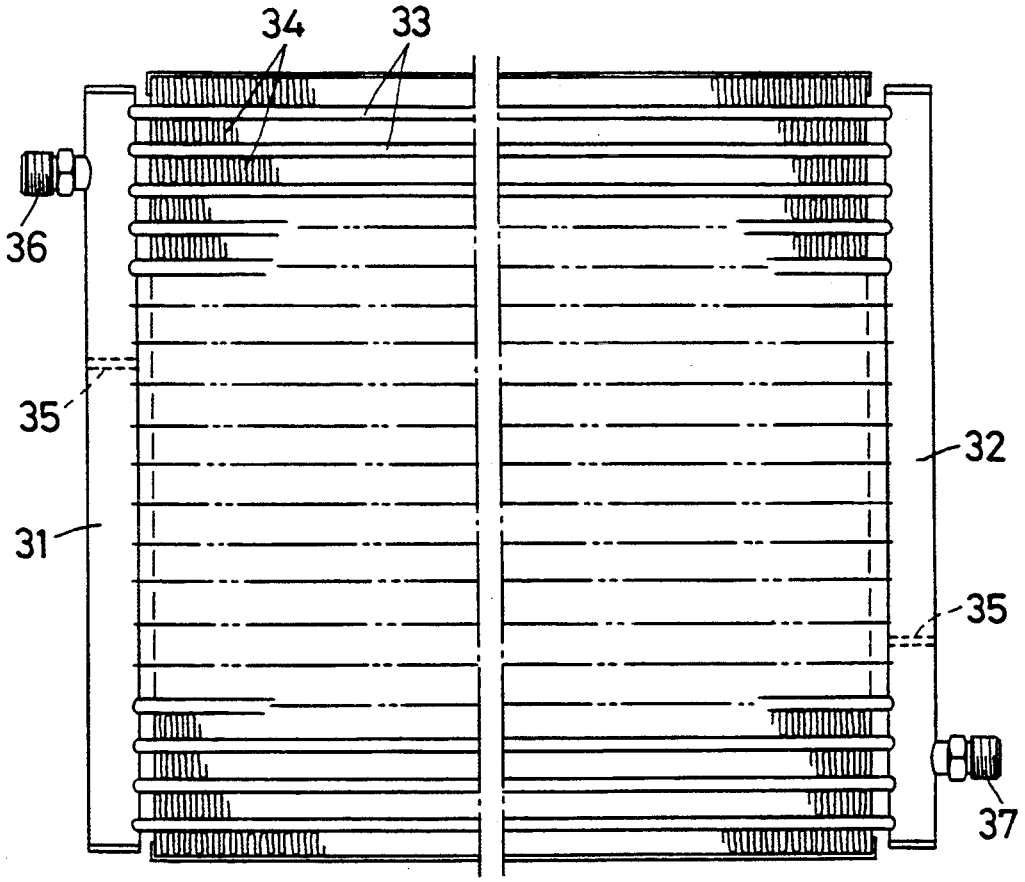
FIG. 13 is a front elevation of a heat exchanger in which the tubes of the invention are incorporated.
Figure 14:
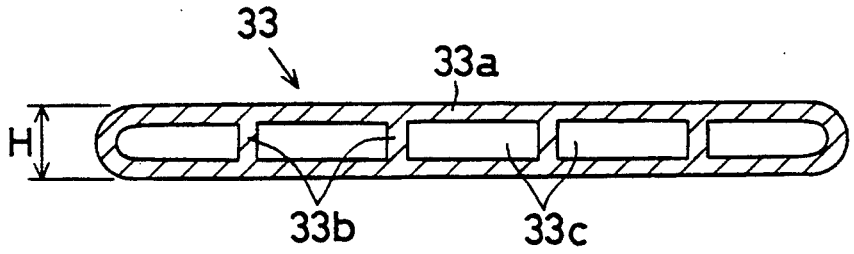
FIG. 14 is a cross-sectional view of a prior art flat tube which is manufactured by the extrusion method.

FIG. 11*a* illustrates a modified means for the preliminary setting, wherein some tongues 23*b* are formed to protrude from the outer edge of each L-shaped bent portion 23*a* of the lower plate $P_2$. Corresponding to the tongues, cutouts 22*b* are formed on each L-shaped bent portion 22*a* of the upper plate $P_1$. With the upper plate $P_1$ overlying the lower one $P_2$, the tongues 23*b* are bent towards the cutouts 22*b* and folded down onto the edges of L-shaped portion, thereby binding the plates to form a tube 21″ as shown in FIG. 11*b*. FIG. 12*a* illustrates another modification in which small round ribs 23*c* protrude upwardly of the L-shaped bent portions 23*a* of lower plate $P_2$. Respective holes 22*c* which are formed through the bent portions 22*a* of upper plate $P_1$ correspond to the respective ribs 23*c*. Tube 21‴ is assembled as shown in FIG. 12*b*, by placing the upper plate $P_1$ upon the lower one $P_2$ and then caulking the tops of ribs 23*c* projecting through the holes 22*c* so as to secure the ribs therein.

Although the curved lugs 26 extend longitudinally of the tube 21, 21′, 21″ or 21‴, those lugs 16 may be or 21 dimple-like protrusions which are formed by recessing the portions of plane walls 22 and 23 inwardly into semispherical shape or U-shape in cross section. In such a case, a plurality of the dimple-like protrusions are distributed over each plane wall. Innermost tops of the upper and lower corresponding protrusions are engaged and soldered integral with each other. Thus, an inner space of the tube becomes a single coolant path of a stray pattern due to such scattered dimple-like protrusions. The coolant flowing through this path will be stirred and assisted by the protrusions to accelerate the heat exchange.

Further, the bent portions of lateral ends may not be bent outwards as in the third embodiment but alternatively be bent inwards.

It will now be apparent that, because either a single thin strip is folded or two thin preformed plates are coupled to form a flat tube for heat exchangers, the tube comprises so thin walls that its height is minimized rendering it to be one of the thinnest types.

It will be understood also that the curved lugs, which protrude from the upper and lower plane walls so as to be engaged and soldered to one another or to the opposite inner surface of the wall, can function as the reinforcing members of the tube, thereby improving its compressive strength and its resistance to internal pressure. Thus, the tube provided for condensers according to the invention is by no means inferior to the flat extruded tube of prior art.

To manufacture the tube of the invention, it is needed merely to apply the conventional integrating technology to the single strip or two plates on which the predetermined curved lugs have been formed. Therefore, the manufacturing process does not involve any difficulty to produce the tubes at a higher productivity and lower manufacturing cost.

Further, in a case wherein the curved lugs extend longitudinally of the tube, its resisting pressure and its flexing strength are increased advantageously. In another case wherein the curved lugs are shaped as the dimples, the coolant is so effectively stirred, while flowing through the tubes' internal paths in the tubes, that their heat exchange efficiency is improved to a remarkable degree.

What is claimed is:

1. A method of manufacturing a tube for a heat exchanger, said method comprising the step of:

(a) bending a flat, elongate sheet with a predetermined width to form at least one curved lug that extends along the length of the sheet and outwardly of one face of the sheet;

(b) folding the sheet along its length to form an elongate, flat tube defining opposite walls disposed in face-to-face relation and having an elongate cross-section with:

(i) opposite edge portions of the sheet contacting each other, (ii) the face from which the lug extends defining the inner surface of the tube, (iii) the lug extending from one of the two opposite walls, and (iv) the distal end of the lug contacting the other of the two opposite walls;

(c) fixedly securing the contacting edge portions of the sheet to each other; and (d) fixedly securing the distal end of the lug to the wall that the distal end contacts.

2. The method of claim 1, wherein the bending step provides a plurality of lugs which extend outwardly from one face of the sheet and lie parallel to one another.

3. The method of claim 1, further comprising the step of coating an obverse and a reverse face of the sheet with brazing agent to fixedly secure the distal end of the lug to the wall that the distal end contacts.

4. The method of claim 1, wherein the bending of the sheet includes gathering the sheet and tightly folding it to form an elongate lug.

5. The method of claim 1, wherein the bending of the sheet produces a dimple-like lug.

6. The method of claim 1, further comprising the step of folding the contacting edge portions of the sheet to form abutting portions which contact each other in abutting, face-to-face relation.

7. The method of claim 1, wherein the contacting edge portions are fixedly secured to each other by welding.

8. The method of claim 1, wherein the contacting edge portions are fixedly secured to each other by brazing.

* * * * *